US006178754B1

(12) United States Patent
Dujarric

(10) Patent No.: US 6,178,754 B1
(45) Date of Patent: Jan. 30, 2001

(54) CRYOGENIC TANK WALL

(75) Inventor: Christian Francois Michel Dujarric, Paris (FR)

(73) Assignee: Agence Spatiale Europeenne (FR)

( * ) Notice: Under 35 U.S.C. 154(b), the term of this patent shall be extended for 0 days.

(21) Appl. No.: 09/342,984

(22) Filed: Jun. 29, 1999

(30) Foreign Application Priority Data

Jul. 1, 1998 (FR) ..... 98 08409

(51) Int. Cl.[7] ..... F17C 3/00
(52) U.S. Cl. ..... 62/45.1
(58) Field of Search ..... 62/45.1

(56) References Cited

U.S. PATENT DOCUMENTS

| | | | | |
|---|---|---|---|---|
| 2,609,068 | | 9/1952 | Pajak . | |
| 3,150,793 | | 9/1964 | Messer . | |
| 3,302,358 | | 2/1967 | Jackson . | |
| 3,931,424 | | 1/1976 | Helf et al. . | |
| 4,023,617 | * | 5/1977 | Carlson et al. | 165/169 |
| 4,404,843 | * | 9/1983 | Johnson et al. | 73/49.2 |
| 5,042,751 | | 8/1991 | Kolom . | |

* cited by examiner

*Primary Examiner*—Corrine McDermott
*Assistant Examiner*—Malik N. Drake
(74) *Attorney, Agent, or Firm*—Bachman & LaPointe, P.C.

(57) ABSTRACT

A structural cryogenic tank wall has an outer skin and an inner skin between which is a cavity containing a thermally insulative structure. The cavity is empty of any gas and contains at least one sensor for continuously verifying that the vacuum is maintained in order to monitor the structural integrity of the outer and inner skins and sealing of the cryogenic tank.

11 Claims, 4 Drawing Sheets

CRYOGENIC TANK WALL

BACKGROUND OF THE INVENTION

1. Field of the Invention

The present invention concerns a structural cryogenic tank wall having an outer skin and an inner skin between which there is a cavity containing a thermally insulative structure.

The invention also concerns a cryogenic tank including a wall of the above kind and equipping terrestrial, maritime or aerospace vehicles necessitating the storage of cryogenic fuels, for example reusable space launch vehicles.

The invention also concerns a method of manufacturing a wall of the above kind and a method of diagnosing faults to which such walls are susceptible.

2. Description of the Prior Art

Reusable space launch vehicles are a promising way to reduce launch costs. Building a launcher of this kind entails solving technical problems such as minimizing the structural mass of the launch vehicle and continuously monitoring the structural integrity of the tanks. To reduce the mass of the launch vehicle it is advantageous for the wall of a cryogenic tank to assure the tank, structure and functional surveillance functions simultaneously.

Most prior art methods for monitoring the functional integrity of the wall of a cryogenic tank are not of a global nature in that they assume that the fault will occur at a particular location where a sensor is installed. Apart from the fact that such methods are complex and incomplete, repairing the tank generally entails total demounting of the faulty structure.

The aim of the invention is to provide a cryogenic tank wall which has a structural function and a tank functional integrity monitoring function.

Another aim of the invention is to facilitate locating and replacing faulty parts of the wall to avoid replacing the entire cryogenic tank.

Another aim of the invention is to prevent atmospheric cryo-pumping.

SUMMARY OF THE INVENTION

The invention consists in a structural cryogenic tank wall having an outer skin and an inner skin between which is an evacuated cavity containing a thermally insulative structure empty of any gas and in which is installed at least one sensor for continuously verifying that the vacuum is maintained in order to monitor the structural integrity of the outer and inner skins and the sealing of the cryogenic tank, which wall has a modular structure constructed by juxtaposing a plurality of adjacent panels, each of the panels being constructed by assembling an outer skin and an inner skin with the evacuated cavity and the sensor between them.

With a wall of the above kind, the origin of the fault can easily be located and only the faulty panels replaced, which minimizes maintenance time and cost.

The thermally insulative structure in the cavity between the skins of the wall is preferably a honeycomb structure whose partitions are either porous or perforated with one or more holes.

Because the cells communicate with each other, if a gas leak occurs in a given cell, it is immediately detected by the sensor installed between the outer wall and the inner wall of the faulty panel.

Other features and advantages of the invention will emerge from the following description, which is given by way of non-limiting example and with reference to the accompanying drawings.

DETAILED DESCRIPTION OF THE PREFERRED EMBODIMENT

Figure 1:
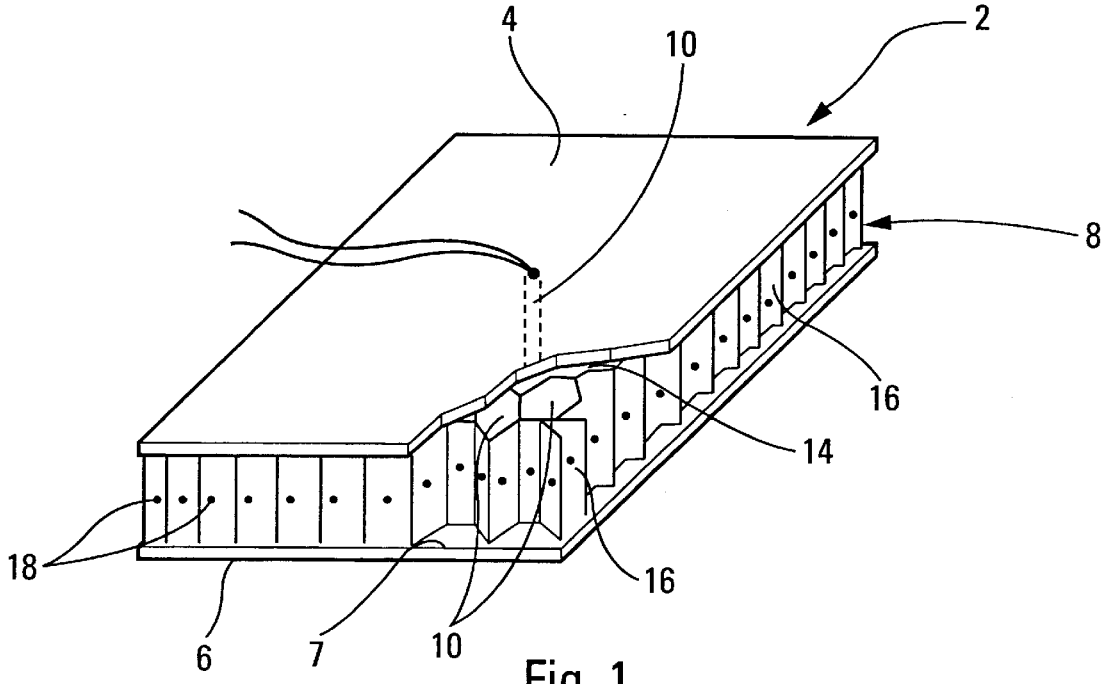
FIGS. 1 and 2 are partial diagrammatic perspective views of a wall in accordance with the invention.
Figure 2:
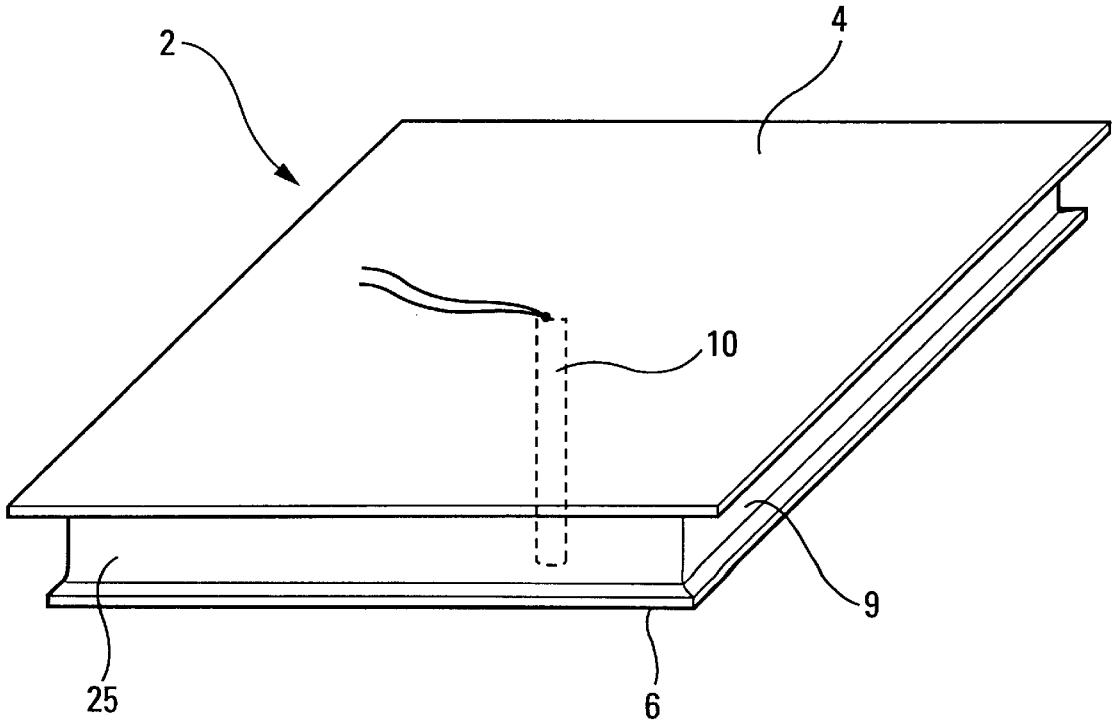

FIGS. 1 and 2 show part of a wall 2 for a structural cryogenic tank having an outer skin 4 and an inner skin 6 forming a sandwich structure enclosing a cavity 7 containing a thermally insulative structure 8.

The cavity 7 is empty of any gas and contains at least one sensor 10 adapted to verify continuously that the vacuum is maintained so as to monitor the structural integrity of the outer skin 4 and the inner skin 6 of the wall 2 and the sealing of the cryogenic tank.

Figure 3:
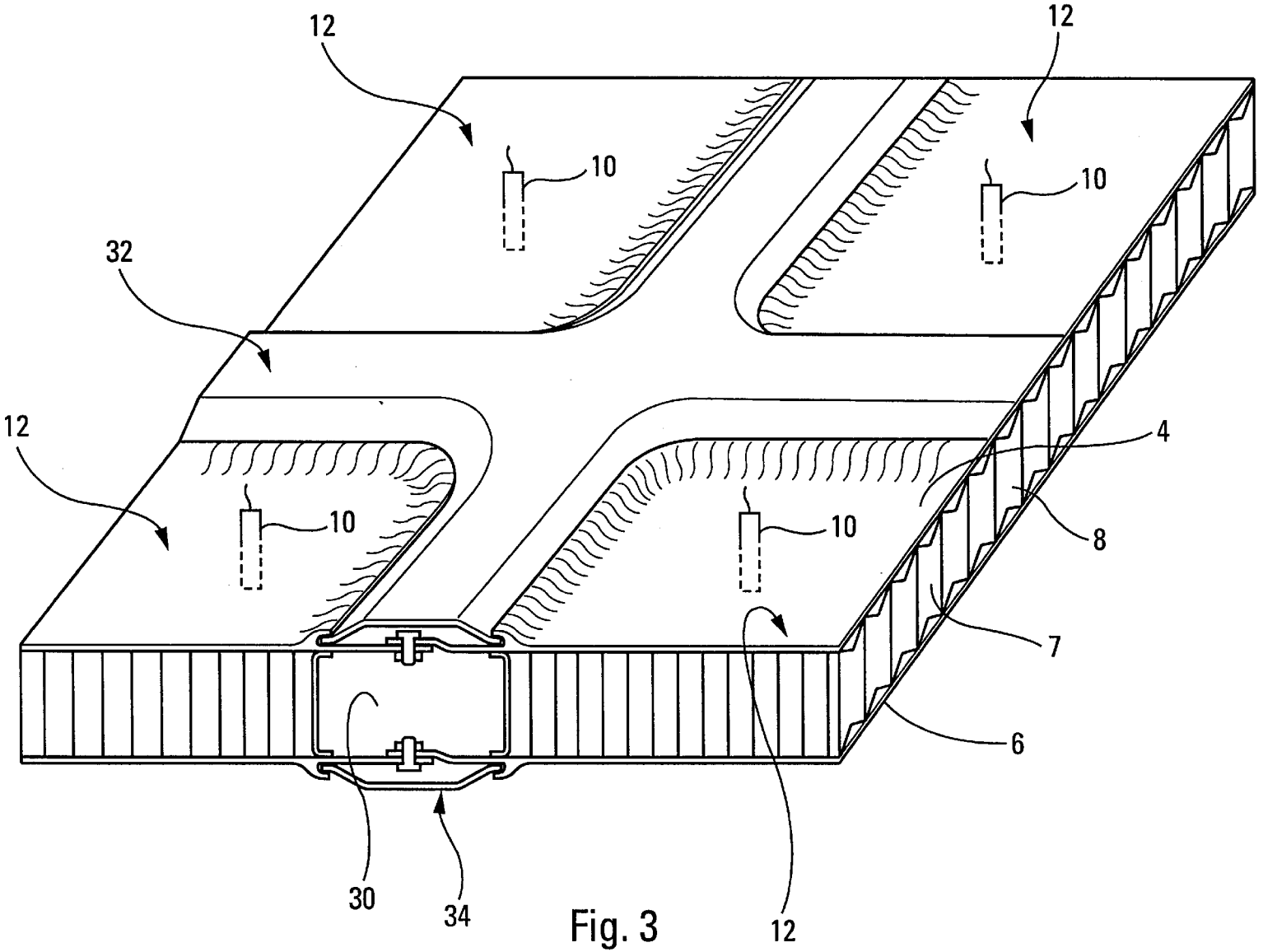
FIG. 3 is a partial perspective view of a preferred embodiment of the wall of the invention.

In a preferred embodiment, shown in FIG. 3, the wall 2 has a modular structure constructed by juxtaposing a plurality of adjacent panels 12. FIG. 3 shows that each panel 12 is constructed by assembling an outer skin 4 and an inner skin 6 enclosing an evacuated cavity 7 containing a thermally insulative structure 8 and a sensor 10 for continuously verifying that the vacuum is maintained in the evacuated cavity 7 in order to monitor the integrity of the outer skin 4 and the inner skin 6 and the sealing of the cryogenic tank.

FIGS. 1 and 3 show that the insulative structure 8 is a honeycomb structure whose partitions 16 are either permeable or perforated with one or more holes 18 to allow the gas to pass from one cell 14 to another in the event of a leak.

Figure 4:
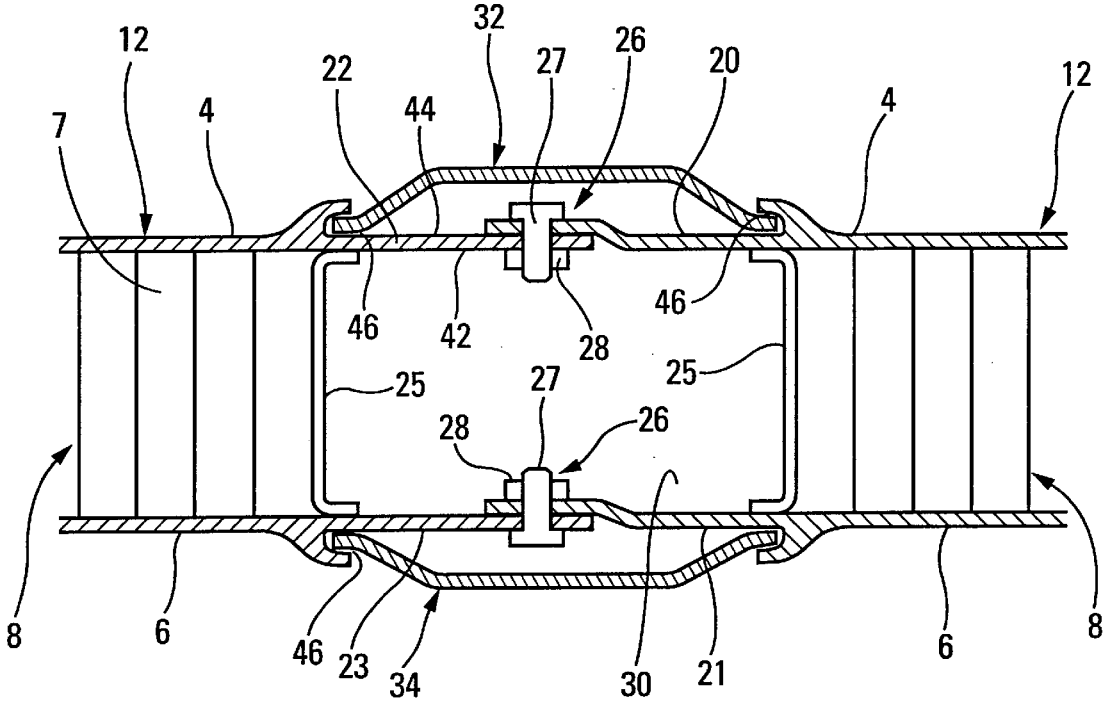
FIG. 4 is a view in vertical section of a wall in accordance with the invention showing a first method of fixing two adjacent panels.
Figure 6:
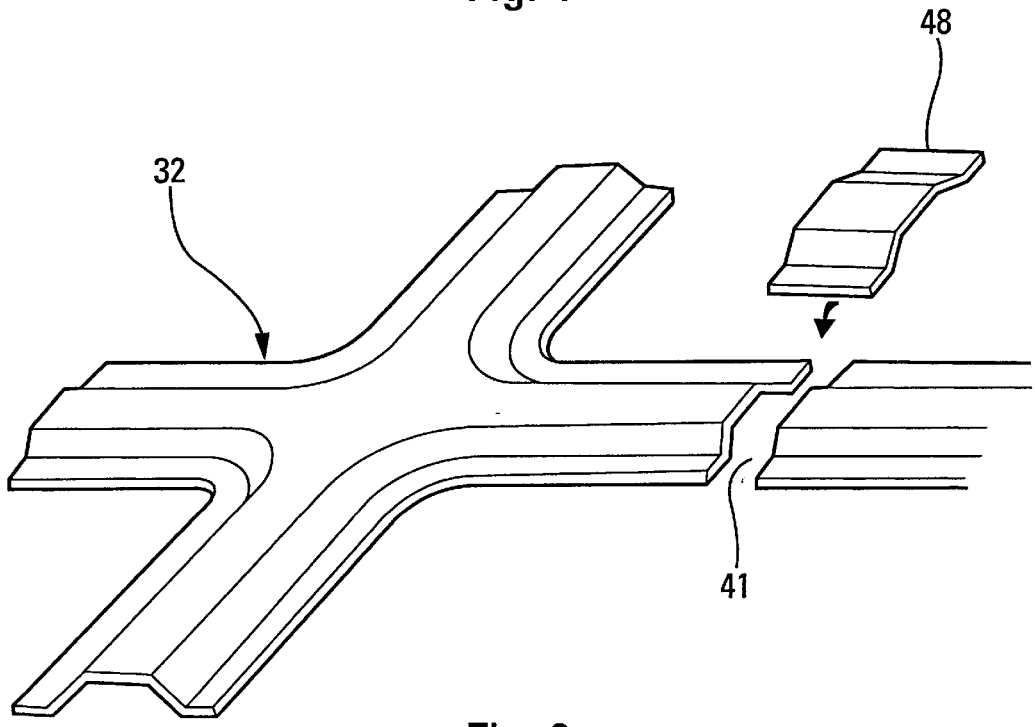
FIG. 6 shows a capping member designed to cover the gap between two adjacent panels of a wall according to the invention.

In a first method of assembling the wall 2, illustrated by FIG. 4, the respective edges 20, 21 and 22, 23 of the outer skins 4 and the inner skins 6 of two adjacent panels 12 project slightly beyond their respective lateral walls 25 and are mechanically joined by fixing means 26 comprising a bolt 27 and a nut 28, for example. In this embodiment, the outer skins 4 and the inner skins 6 are preferably made of a composite material and the lateral walls 25 of the panels 12 are also made of composite materials. The coefficient of thermal expansion of the insulative structure 8 is similar to that of the inner skin 6. Also, forces applied to the wall 2 are transmitted from the outer skin 4 (respectively the inner skin 6) of one panel 12 to the outer skin 4 (respectively the inner skin 6) of the adjacent panel 12.

Figure 5:
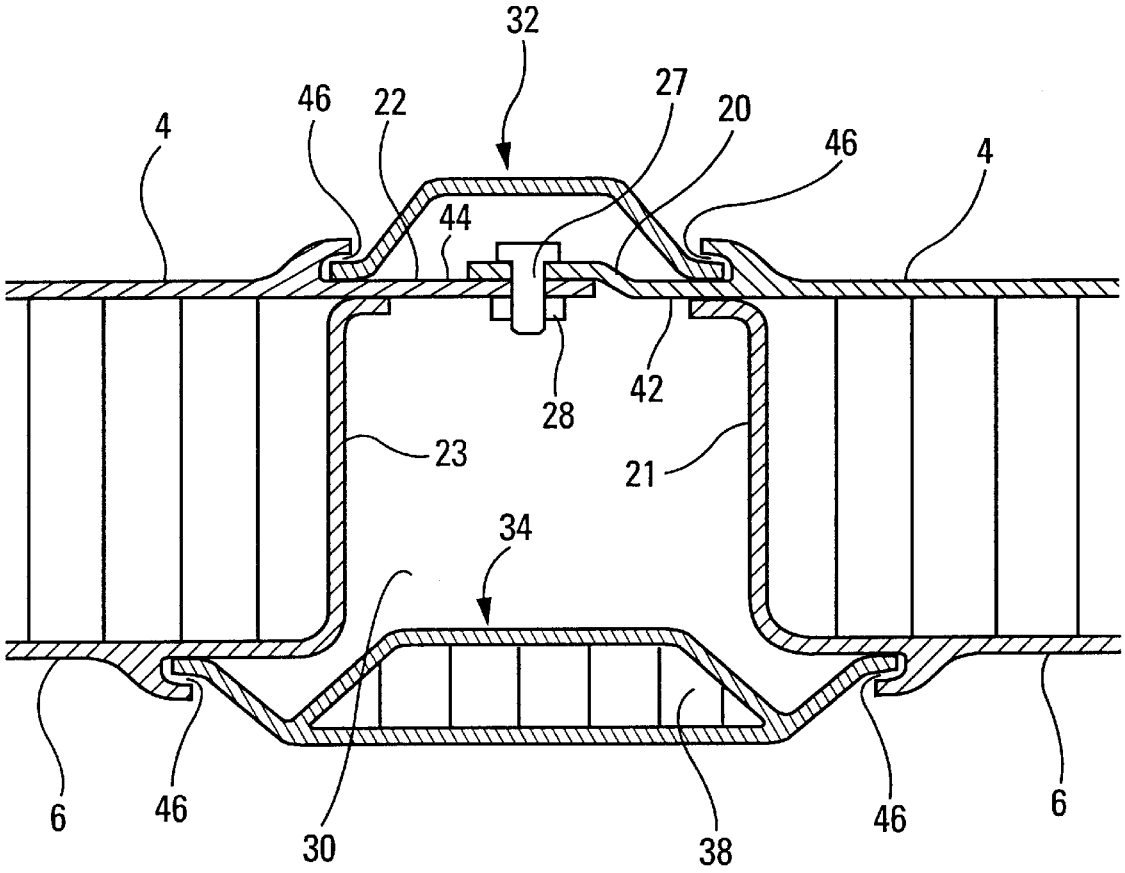
FIG. 5 is a view in vertical section of a wall in accordance with the invention showing a second method of fixing two adjacent panels.

In a second assembly method, illustrated by FIG. 5, two adjacent panels 12 are joined mechanically so that mechanical forces applied to the wall 2 are transmitted only by the outer skin 4. In this embodiment, the inner skin 6 of each of the adjacent panels 12 is fixed to the outer skin 4 of that panel. The outer skins 4 can be made either of metal or of a composite material. The inner skins 6 of the panels 12 are preferably made of composite materials. The coefficient of thermal expansion of the insulative structure 8 is low and similar to that of the inner skin 6.

In accordance with an important feature of the invention, the space 30 between the lateral walls 25 of two adjacent panels 12 is evacuated and covered by a first capping member 32 and a second capping member 34 which are cruciform or T-shaped and are respectively attached to the outer skins 4 and the inner skins 6 of the adjacent panels. The space 30 contains a sensor (not shown) for verifying that the vacuum is maintained therein.

In the second embodiment, illustrated by FIG. 5, the capping member 34 is stiffened by a sandwich structure.

To facilitate mounting/demounting the panels, the edges (20, 21) of the outer skins 4 of two consecutive panels 12 are fixed alternately to the bottom face 42 and to the top face 44 of the outer skin 4 of the adjacent panel 12 to produce a periodic pattern.

To manufacture the cryogenic wall 2, the panels 12 are progressively assembled with intermediate load transfer members and assembly end members interleaved between them, as necessary, in particular at the entry and exit of filler/drain pipes. The geometry of the assembly end members matches the geometrical and mechanical characteristics required of the wall 2. These members seal the cavity 30 between the panels. All the cavities 30 between panels are then covered by capping members 32, 34 which are forcibly inserted and then glued into housings 46 provided for this purpose on the outer skins 4 and inner skins 6. The joints between the ends 46 of consecutive capping members 32, 34 are then covered with auxiliary capping members 48 to seal them.

A failure in the wall 2 is diagnosed by detecting loss of vacuum in the cavities 30 between panels or in the cavities 7 between the outer skins 4 and the inner skins 6 of the panels 12. The failure of a panel 12 is detected by means of the sensor 10, which is connected to a central processor unit (not shown). If a leak is detected in a panel 12 that panel is changed, but if loss of vacuum is detected in the cavity 30 between panels a trace gas is injected into the cavity 30 between panels to locate the leak precisely and the capping member (32, 34) corresponding to the leak is changed.

There is claimed:

1. A structural cryogenic tank wall having a modular structure constructed by juxtaposing a plurality of adjacent panels, each of said panels having an outer skin and an inner skin delimiting a cavity containing a thermally insulating structure empty of any gas and in which is installed at least one sensor for continuously verifying that a vacuum is maintained in said cavity in order to monitor a structural integrity of said outer and inner skins and a sealing of said cryogenic tank wall.

2. The wall claimed in claim 1 wherein said thermally insulating structure is a honeycomb structure whose partitions are porous or perforated with at least one hole.

3. The wall claimed in claim 1 wherein said outer skin and said inner skin of two adjacent panels are joined mechanically so that forces applied to said wall are transmitted from said outer skin of one panel to said outer skin of an adjacent panel.

4. The wall claimed in claim 1 wherein two adjacent panels are joined mechanically so that mechanical forces applied to said wall are transmitted only by said outer skins and said inner skin of each of said adjacent panels is fixed to said outer skin of said panel.

5. The wall claimed in claim 1 wherein edges of said outer skins of two consecutive panels are alternately fixed to a bottom face and a top face of said outer skin of an adjacent panel to create a periodic pattern.

6. The wall claimed in claim 1 wherein said outer skins and said inner skins each are made of a composite material and said lateral walls of said panels are also made of a composite material and said insulating structure has a coefficient of thermal expansion similar to that of said inner skin.

7. The wall claimed in claim 1 wherein said outer skins are made of metal or a composite material, said inner skins are made of a composite material, and said insulating structure has a coefficient of thermal expansion similar to that of said inner skin.

8. A cryogenic tank having at least one wall as claimed in claim 1.

9. A structural cryogenic tank wall having a modular structure constructed by juxtaposing a plurality of adjacent panels, each of said panels having an outer skin and an inner skin delimiting a cavity containing a thermally insulating structure empty of any gas and in which is installed at least one sensor for continuously verifying that a vacuum is maintained in said cavity in order to monitor a structural integrity of said outer and inner skins and a sealing of said cryogenic tank, said panels having lateral walls delimiting with lateral walls of adjacent panels a space which is empty of any gas and covered by a first capping member and a second capping member, said capping members being cruciform or T-shaped and being respectively attached to said outer skins and said inner skins of said adjacent panels, said space containing a sensor for verifying that a vacuum is maintained in said space.

10. The wall claimed in claim 9 wherein at least one of said capping members is stiffened by a sandwich structure.

11. A method of manufacturing a cryogenic wall comprising the steps of:

providing a plurality of panels each of which has been constructed by assembling an outer skin and an inner skin with an evacuated cavity and a sensor between said skins;

juxtaposing said plurality of panels and forming at least one cavity between adjacent ones of said panels;

progressively assembling said panels using intermediate force transfer members and assembly end members, which assembly end members have a geometry which matches required geometrical and mechanical characteristics of said wall, so as to seal each said cavity between said panels;

covering each said cavity between said panels with capping members which are forcibly inserted and then glued into housings in said outer skins and said inner skins of said panels; and covering joints between ends of consecutive capping members with auxiliary capping members.

* * * * *